US007052250B2

(12) United States Patent
Miura et al.

(10) Patent No.: US 7,052,250 B2
(45) Date of Patent: May 30, 2006

(54) RECIPROCATING COMPRESSOR

(75) Inventors: Haruo Miura, Tokyo (JP); Shigeru Arai, Tokyo (JP); Youichirou Fukai, Tokyo (JP); Yasuo Fukushima, Tokyo (JP)

(73) Assignee: Hitachi Industries Co., Ltd., Tokyo (JP)

( * ) Notice: Subject to any disclaimer, the term of this patent is extended or adjusted under 35 U.S.C. 154(b) by 393 days.

(21) Appl. No.: 10/600,542

(22) Filed: Jun. 23, 2003

(65) Prior Publication Data

US 2004/0057842 A1 Mar. 25, 2004

(30) Foreign Application Priority Data

Sep. 25, 2002 (JP) ..... 2002-278316

(51) Int. Cl.
*F04B 23/00* (2006.01)
*F04B 39/00* (2006.01)
*F04B 53/00* (2006.01)

(52) U.S. Cl. ..... 417/313; 417/254

(58) Field of Classification Search ..... 417/254, 417/313

See application file for complete search history.

(56) References Cited

U.S. PATENT DOCUMENTS

| | | | | | |
|---|---|---|---|---|---|
| 2,933,049 | A | * | 4/1960 | Johnston | 92/86 |
| 3,510,233 | A | | 5/1970 | Strebel et al. | |
| 3,657,972 | A | * | 4/1972 | Strebel et al. | 92/128 |
| 3,657,973 | A | | 4/1972 | Wahrenberger | |
| 3,677,107 | A | | 7/1972 | Strebel et al. | |
| 3,801,167 | A | | 4/1974 | Strebel | |
| 3,885,460 | A | | 5/1975 | Park | |
| 4,756,674 | A | | 7/1988 | Miller | |
| 5,240,386 | A | | 8/1993 | Amin et al. | |
| 5,247,873 | A | * | 9/1993 | Owens et al. | 92/157 |
| 5,507,219 | A | * | 4/1996 | Stogner | 92/128 |
| 5,702,238 | A | * | 12/1997 | Simmons et al. | 417/380 |
| 5,823,093 | A | * | 10/1998 | Kugelev et al. | 92/128 |
| 6,164,188 | A | * | 12/2000 | Miser | 92/84 |
| 6,382,940 | B1 | * | 5/2002 | Blume | 417/571 |
| 6,396,532 | B1 | | 5/2002 | Hoover et al. | |
| 6,558,135 | B1 | * | 5/2003 | Wood | 417/254 |
| 6,648,612 | B1 | * | 11/2003 | Hsiao | 417/313 |
| 6,910,871 | B1 | * | 6/2005 | Blume | 417/571 |

FOREIGN PATENT DOCUMENTS

| | | |
|---|---|---|
| FR | 534002 | 3/1922 |
| GB | 1312843 | 4/1973 |
| JP | 48-12500 | 4/1973 |

OTHER PUBLICATIONS

"Diaphragm Compressor" issued by TEISAN Ltd., Jun. 1982, with English abstract and figure.
European Search Report Mailed Aug. 31, 2004.

* cited by examiner

*Primary Examiner*—William Rodriguez
(74) *Attorney, Agent, or Firm*—Crowell & Moring LLP

(57) ABSTRACT

A reciprocating compressor, being small-sized and compact, for compressing hydrogen gas to be used in a fuel-cell car, has a crankshaft, to which an end of a connecting rod is connected. The other end of the connecting rod is connected to a crosshead. To the crosshead are connected a pair of shafts, each extending in directions opposing to each other. To each of the shafts is connected a plunger. The each plunger is received within a cylinder at the tip portion thereof. A pair of plungers moves reciprocally on an almost same axis, and the crosshead is formed in one body.

17 Claims, 8 Drawing Sheets

RECIPROCATING COMPRESSOR

BACKGROUND OF THE INVENTION

The present invention relates to a reciprocating compressor for compressing an actuating gas up to supper-high pressure, and in particular, relates to a two-stage reciprocating compressor being suitable for compression of hydrogen gas for use, in particular, in a fuel-cell car.

Conventionally, it is already described that a diaphragm compressor is adopted, for preventing lubricating oil from mixing into a process line, as a compressor for compressing actuating gas, in a catalogue "A Diaphragm Compressor" issued in June 1982, by TEISAN, Co. Ltd., for example. Since being able to prevent the lubricating oil from mixing into, it is proposed to adopt such a kind of the compressor as the compressor for compressing hydrogen gas to be used in the fuel-cell car.

On a while, compressors are described, which compresses actuating gas up to pressure exceeding over 300 MPa, for use in a large-scale plant of 20,000–30,000 kW, for example, in U.S. Pat. No. 3,657,973, Great Britain Patent No. 1,312,843, Japanese Patent Publication No. Sho 48-12500 (1973) (U.S. Pat. No. 3,677,107), U.S. Pat. Nos. 3,801,167, and 3,510,233. Among of those, with the compressor described in U.S. Pat. No. 3,657,973, rotating movement of a crankshaft is converted into reciprocating movement of a crosshead of a frame shape. And, a plunger moves reciprocally, while a rod is guided along with a guide cylinder, and the actuating gas is compressed up to high pressure within a compressor chamber formed at a tip portion of the plunger.

More details of such a crosshead of the frame-like structure, relating to the conventional art, are described in Great Britain Patent No. 1,312,843, and also Japanese Patent Publication No. Sho 48-12500 (1973) mentioned above. In those documents, the crosshead of the frame-like structure has an upper part, a lower part and a central part thereof, and they are connected by means of a clamping bolt, clamping them at the same time. Also, a connecting rod has the structure of being divided or separated into a cross-pin portion and a crankshaft portion. Further, details of a guide-piston in such the conventional compressor are shown in U.S. Pat. No. 3,801,167 mentioned above, and details of a rod-packing seal in U.S. Pat. No. 3,510,233 mentioned above.

With the diaphragm-type compressor described in the catalogue "Diaphragm Compressor" of TEISAN, Co. Ltd., since a large amount of the lubricating oil mixes into the process line when the diaphragm is broken, therefore it is necessary to ascertain reliability of the diaphragm. For this reason, the diaphragm must be strong and large-sized under the specification of high pressure or super-high pressure, and is inconvenient to be made compact in the size thereof.

Also, in those compressors described in U.S. Pat. No. 3,657,973, Great Britain Patent No. 1,312,843, Japanese Patent Publication No. Sho 48-12500 (1973) (U.S. Pat. No. 3,677,107), U.S. Pat. Nos. 3,801,167, and 3,510,233, each the diaphragm is complex in the shape thereof, depending on the specification of the compressor, and it increases the number of steps when assembling or disassembling the compressor. Furthermore, in those documents, a certain amount of consideration was paid on the fact that the actuating gas of the compressor leaks out therefrom, however the consideration is not yet sufficient enough, in particular, for the case where the actuating gas is a flammable one, such as hydrogen gas, for example.

BRIEF SUMMARY OF THE INVENTION

An object, according to the present invention, is to provide a reciprocating compressor being small and compact. Other object of the present invention is to achieve a reciprocating compressor, being suitable for compressing the hydrogen gas to be used in a fuel-cell car. Further other object of the present invention is to achieve a reciprocating compressor of high reliability. And, according to the present invention, it is an object to achieve at least one of those objects mentioned above.

According to the present invention, for achieving the object mentioned above, there is provided a reciprocating compressor, comprising: a crankshaft; a connecting rod, one end thereof being to said crankshaft; a crosshead, being connected with the other end of said connecting rod, as well as, a pair of intermediate shafts, each of which extends in opposing directions to each other; a pair of plungers, each of which is connected to each of said intermediate plunger; and cylinders, each receiving a tip portion of said plunger therein, wherein said pair of plungers moves reciprocally on almost same axis, and said crosshead is formed in one body.

Also, according to the present invention, in the reciprocating compressor as described in the above, preferably, further comprising a crankcase for receiving said crankshaft, said crosshead and said connecting rod therein, wherein on a side surface of said crankcase is formed an opening portion for installing or taking out said crankshaft; wherein gas compressed by one of said plungers is guided into a compression space which is defined between the other of said plungers and one of said cylinder; wherein said connecting rod has a first member and a second member, being formed into two(2)-divided shape and linked with said crankshaft, and a third member linked with a cross pin provided at a connection portion with said crosshead; wherein each of said pair of shafts has a large diametric guiding portion for guiding said plunger to move reciprocally, and a small diametric portion located within said guide portion on a side of said plunger; wherein each of said pair of shafts has a guide portion for guiding said plunger to move reciprocally, and a seal ring is attached onto an outer periphery surface of said guide portion; wherein rod-packing seals, which are laminated in multiple-stages in an axial direction thereof, are provided on an outer periphery side of said each plunger, and said rod packing seals are divided into a high-pressure side seal portion and a low pressure side seal portion by conducting a middle portion of said rod packing seals in an axial direction thereof to a suction flow passage of gas sucked into said compressor; wherein the rod packing of said low-pressure side seal portion includes a material, being softer than the rod packing of said high-pressure side seal portion; and wherein the rod packing of said low-pressure side seal portion includes a resin material.

Further, according to the present invention, for achieving the object mentioned above, there is also provided a reciprocating compressor of two stages, having: a crankshaft; and a pair of plungers, said plungers being disposed on sides opposing to each other, so as to put the crankshaft therebetween on a same axis thereof, wherein operating gas is compressed by converting rotating movement of said crankshaft into reciprocating movement of said pair of plungers, and further comprising: rod packing seals, each being formed in multiple-stages in an axial direction thereof and disposed on an outer periphery portions of each of said plungers; cylinder rings, being disposed on said rod packing seals at a tip side of each of said plungers; and cylinder cases, each being provided for covering an outer periphery portions of said rod packing seal and said cylinder ring, which are made to be almost same in an outer diameter thereof, wherein fine gap passages are formed between said cylinder case and an outer peripheries of said rod packing seals and said cylinder ring, conducting in an axial direction of said plunger, thereby making up a leakage passage of the operating gas with said fine gas passages.

Also, according to the present invention, in the reciprocating compressor as described in the above, preferably, wherein each of said fine gap passages is a groove for use of a nock pin for positioning in a peripheral direction; wherein other cylinder case is provided for fitting to said cylinder case on an outer periphery thereof, thereby forming a cooling jacket between said cylinder case and the other cylinder case; wherein flows either one of cooling water and cooling oil flows through said cooling jacket; and wherein one of said plungers and said crankshaft are connected with each other through a connecting rod, a crosshead and a shaft, while other of said plungers is connected to said crosshead through other shaft.

And also, according to the present invention, in the reciprocating compressor as described in the above, preferably, wherein the operating gas is high-pressure hydrogen gas, and discharge pressure of said compressor is equal to or large than 40 MPa and is equal to or lower than 84 MPa; wherein a filter means is provided at a discharge side of said compressor, for removing lubricating oil contained within the operating gas, which leaks out from said compressor; and wherein the operating gas is high-pressure hydrogen gas, thereby supplying high-pressure hydrogen gas to a hydrogen gas containing means to be used in a fuel-cell car.

DETAILED DESCRIPTION OF THE INVENTION

Figure 1:
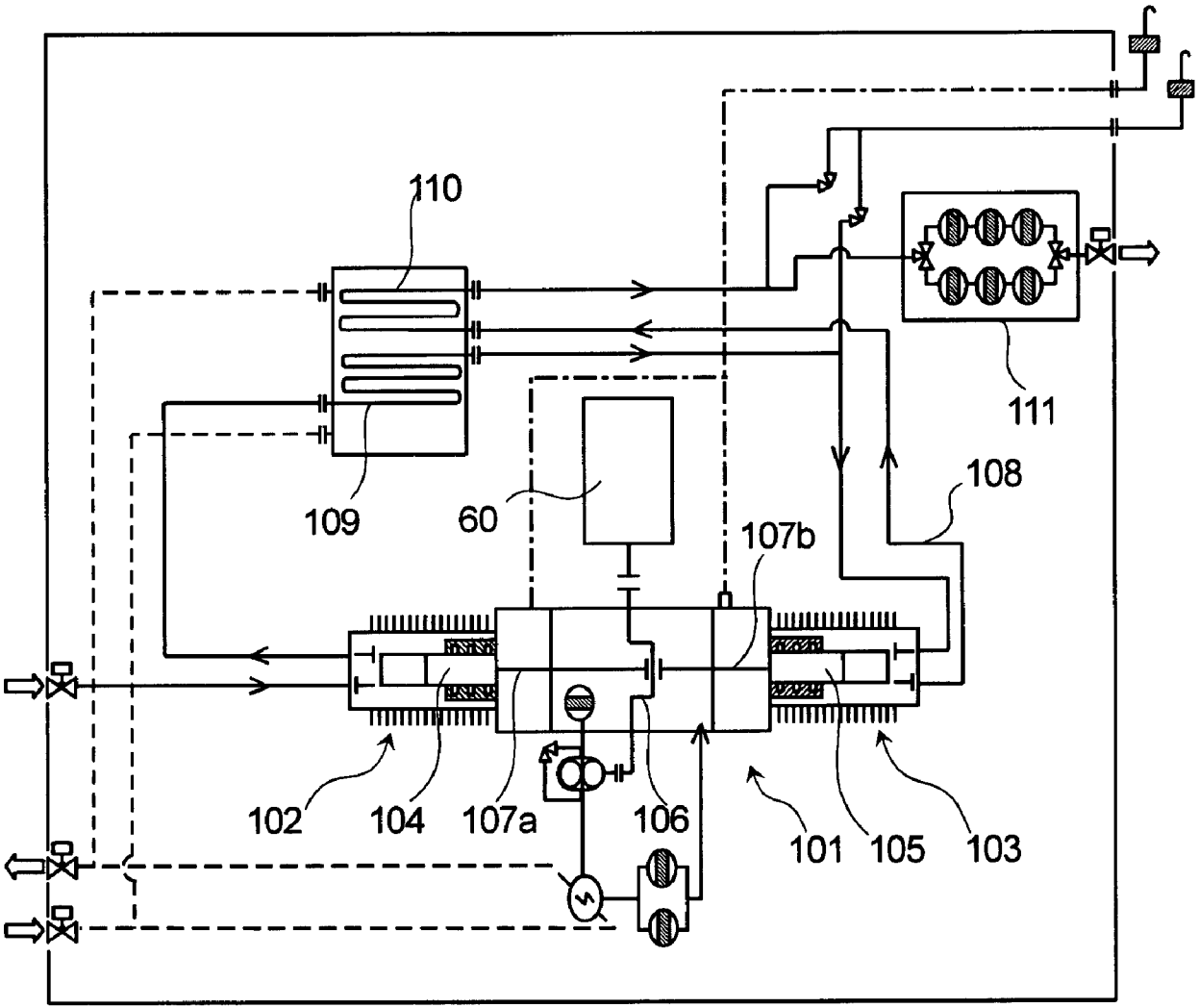
FIG. 1 is a system flowchart in one embodiment of a plunger-type reciprocating compressor, according to the present invention.

Hereinafter, explanation will be given on an embodiment of a reciprocating compressor, according to the present invention. FIG. 1 is a system flowchart in one embodiment of a plunger-type high-pressure compressor of a small capacity, according to the present invention. The reciprocating compressor 101 is a so-called two(2)-stage compressor, having a first compression stage 102 and a second compression stage 103. Within the first compression stage 102, a plunger 104 is received within an inside of a cylinder, and within the second compression stage 103, a plunger 105 is received within an inside of a cylinder. The plungers 104 and 105 are disposed or aligned on the same axis.

Each of those plungers 104 and 105 is connected a shaft 107a or 107*b*, and those shafts 107*a* and 107*b* are driven by a motor 60, which is connected to a crankshaft 106. With such the structure, rotation movement can be converted into reciprocating movement, thereby compressing an actuating gas within a compression chamber, each being defined between a tip of the plunger 104 or 105 and the corresponding cylinder.

The actuating gas flows from a suction port of the first compression stage 102 into the compressor, to be compressed, and it is discharged from a discharge port of the first compression stage 102. Next, it is guided into a gas cooler 109 through a conduit 108, to be cooled down. The actuating gas cooled in the gas cooler 109 is guided into a suction portion of the second compression stage 103, wherein it is increased up further in pressure, and it is sent from a discharge port of the second compression stage into a gas cooler 110, to be cooled down therein. Thereafter, it is sucked into a filter unit 111, thereby filtering out lubricating oil or the like, contained in the actuating gas, and then it is send out to a consumer side.

Figure 2:
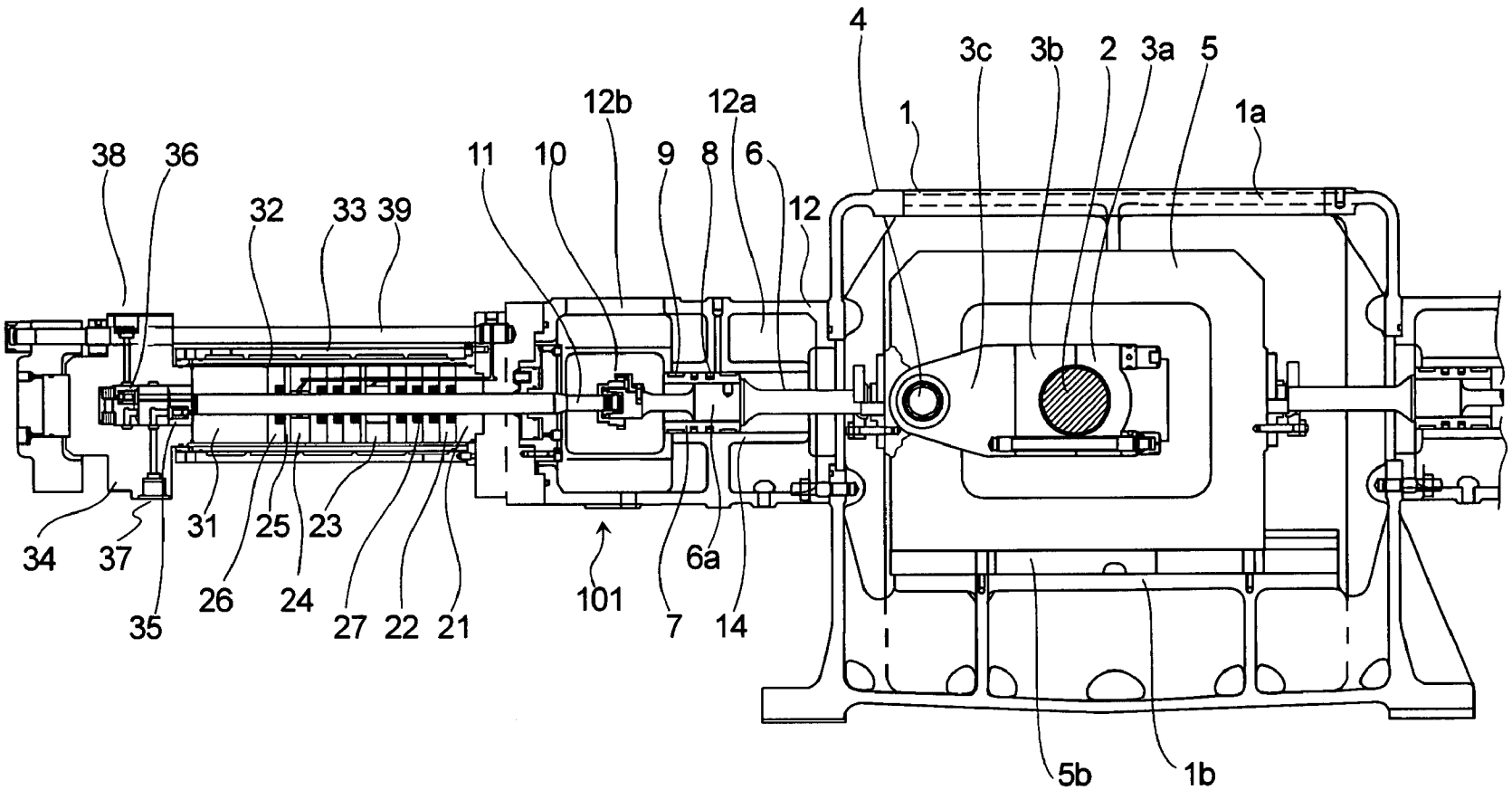
FIG. 2 is a partial vertical cross-section view of the plunger-type reciprocating compressor, which is applied in the system shown in FIG. 1, above.
Figure 3:
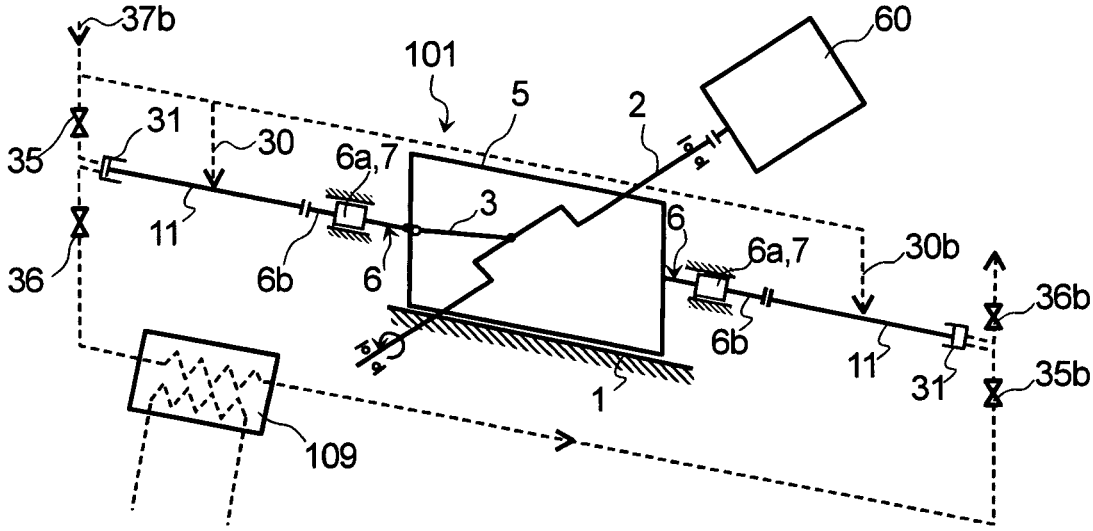
FIG. 3 is an illustrative view of the plunger compressor shown in FIG. 2.

FIG. 2 shows a partial vertical cross-section view of the reciprocating compressor, which is applied in the system shown in FIG. 1. The reciprocating compressor has compression stages on both side of a crankcase 1; however, in this FIG. 2, the compression stage at the right-hand side is omitted. The structure of the compression stage at the right-hand side is almost same to that of the compression stage at the left-hand side. In FIG. 3 is shown an outline of the reciprocating compressor shown in FIG. 2.

The crankcase 1 is disposed at about a central portion of the compressor 101. A rectangular-shaped crosshead 5 is received within this crankcase. On a lower surface of the crosshead 5 is attached a shroud 5*b*, for enabling to slide between a receiving surface 1*b* of the crankcase 1 via a film of lubricating oil. A material of this shroud 5*b* is selected to be, such as LBC, being superior in sliding property, for example. On both side surfaces of the crosshead 5 are attached intermediate shafts 6. However, the crosshead 5 is made in one body without joint line, and it is formed from a steel plate, through cutting and machining thereof.

Into an inside of a frame of the crosshead 5, a crankshaft 2 is inserted, penetrating through a paper surface of drawing. The crankshaft 2 is connected to a motor 60. Onto a crank portion 2*a* of the crankshaft 2 are attached connecting rod members 3*a* and 3*b*, which are in a two(2)-divided shape, in a rotatable manner. A cross pin 4 is attached onto a frame portion of the crosshead at the left-hand side thereof, being perpendicular to this frame portion, and into this cross pin 4 are inserted a pair of connecting rod members 3*c*, in a rotatable manner. This connecting rod members 3*c* are squeezed up together with the connection rod members 3*a* and 3*c*, by means of a screw bolt 3*d*, to be formed in one body, thereby forming a connecting rod 3.

Figure 4:
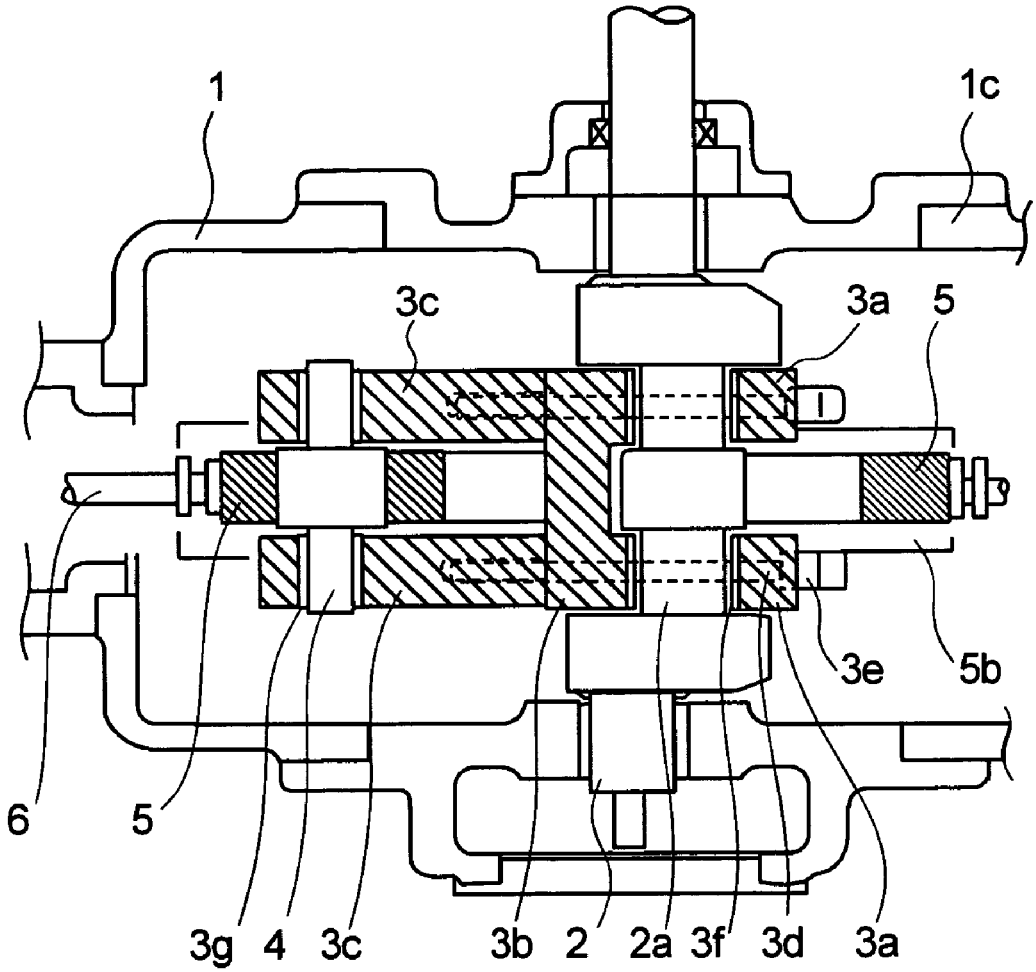
FIG. 4 is a plane cross-section view, in particular, of a crank chamber of the plunger compressor shown in FIG. 2.

Details of the connection rod 3 will be explained by referring to a plane cross-section view shown in FIG. 4. On an inner peripheral surface of each of the connecting rod members (e.g., a cap for use of a large metal) 3*a* and 3*b*, being formed into the two(2)-divided shape, a shaft receiving surface 3*f* is formed, so that it can slide with respect to the crank portion 2*a* of the crankshaft 2 via the lubricating oil film lying therebetween. In a similar manner, on an inner surface of the connecting rod 3*c*, a shaft receiving surface 3*g* is formed, so that it can slide between the cross pin. Those shaft receiving surfaces 3*f* and 3*g* are made of, such as, white metal, aluminum alloy or copper alloy, for example.

Explanation will be given on a method for assembling three (3) members of the connecting rod 3 formed in this manner. The crankshaft 2 penetrates through within the frame of the crosshead 5 after the crosshead 5 is received inside the crankcase 1. In more details, the crosshead 5 having a frame-like structure of one-body is installed from an upper surface opening portion 1*a* (see FIG. 1) of the crankcase 1, and next the crankshaft 2 is installed from a side surface opening portion 1*c* penetrating through the frame of the crosshead 5. However, the crosshead 5 is fixed in advance, by inserting the cross pin 4 into an opening formed therein. And, a pair of connecting rods 3*c* and 3*c* are assembled, so as to put the crosshead 5 therebetween.

Next, the crosshead 5 is pushed toward an opposite side of the crankshaft 2; e.g., the most left-hand side. In this instance, the crankshaft 2 is formed, so that a crank portion 2*a* thereof comes to the most left-hand side. Under this condition, the connecting rod member 3*b* is mounted on the connecting rod 3*c*. Next, after rotating the crankshaft 2, thereby to be engaged or linked with the connecting rod member 3*b*, the connecting rod member 3*a* is attached to the connecting rod member 3*b*. Finally, those connecting rod members 3*a*, 3*b* and 3*c* are squeezed up by using the crew bolt 3*d* and nut 3*e*.

The intermediate shafts 6 are fixed on both side surfaces of the crosshead 5 through bolts. A large diametric portion 6a is formed in the middle portion of the intermediate shaft 6, and around the outer periphery thereof is fitted a guide piston 7. Around the outer periphery portion of the guide piston 7, grooves are formed for holding a shoe 9 and a seal ring 8 therein, so that the guide piston can slide with respect to the guide cylinder 14, via the lubricating oil film or under a dried condition therebetween. On a side of the intermediate shaft 6, being opposite to the crosshead rather than the large diametric portion thereof; e.g., the left-hand side in FIG. 2, there is formed a small diametric portion 6*b*, being smaller than the large diametric portion 6*a* in the diameter thereof. The intermediate shaft 6 is connected with a plunger 11 through a joint portion 10 at a tip thereof. The shoe 9 is made of material, such as, PEEK (PolyEther Ether Ketone), for example, and the seal ring 8 is made of a resin, such as, tetrafluoroethylene, for example.

Since the small diametric portion 6*b* is provided for the purpose of obtaining a similar function to a torsion bar, it is possible to absorb displacement of the plunger 11 in the radius direction thereof when the plunger is shifted in the axial center thereof due to abrasion of a plunger guide ring 28. Namely, it is possible to reduce swinging, accompanying with the reciprocating movement of the plunger 11, in a direction perpendicular to the axis thereof, through the flexibility of that small diametric portion, thereby preventing the actuating gas from leaking out therefrom, as well as, obtaining a long life-time of the packing.

Intermediate shaft cases 12 are attached on both sides of the crankcase 1, each for receiving the intermediate shaft 6, the guide cylinder 14 and the joint portion 10 therein. At a middle portion of this intermediate shaft case 12 in the vertical direction thereof, a guide cylinder 14 is formed, so that the intermediate shaft 6 can make reciprocating movement, and in the axial direction thereof are formed an inner-side distant chamber 12*a* and an outer-side distant chamber 12*b*.

The plunger 11 made of tungsten carbide is a thin and long bar, having almost same diameter thereof, and it has only a small diameter only at the side of the joint portion 10. A cylinder ring 31 is disposed on an outer periphery side at the tip portion of the plunger 11, for defining a compression chamber between the plunger 11. A valve block 34 is disposed at the tip of the plunger. A shaft-sealing portion, being piled up in multiple-stages in the axial direction thereof, is formed between the joint portion 10 and the cylinder ring 31.

Figure 5:
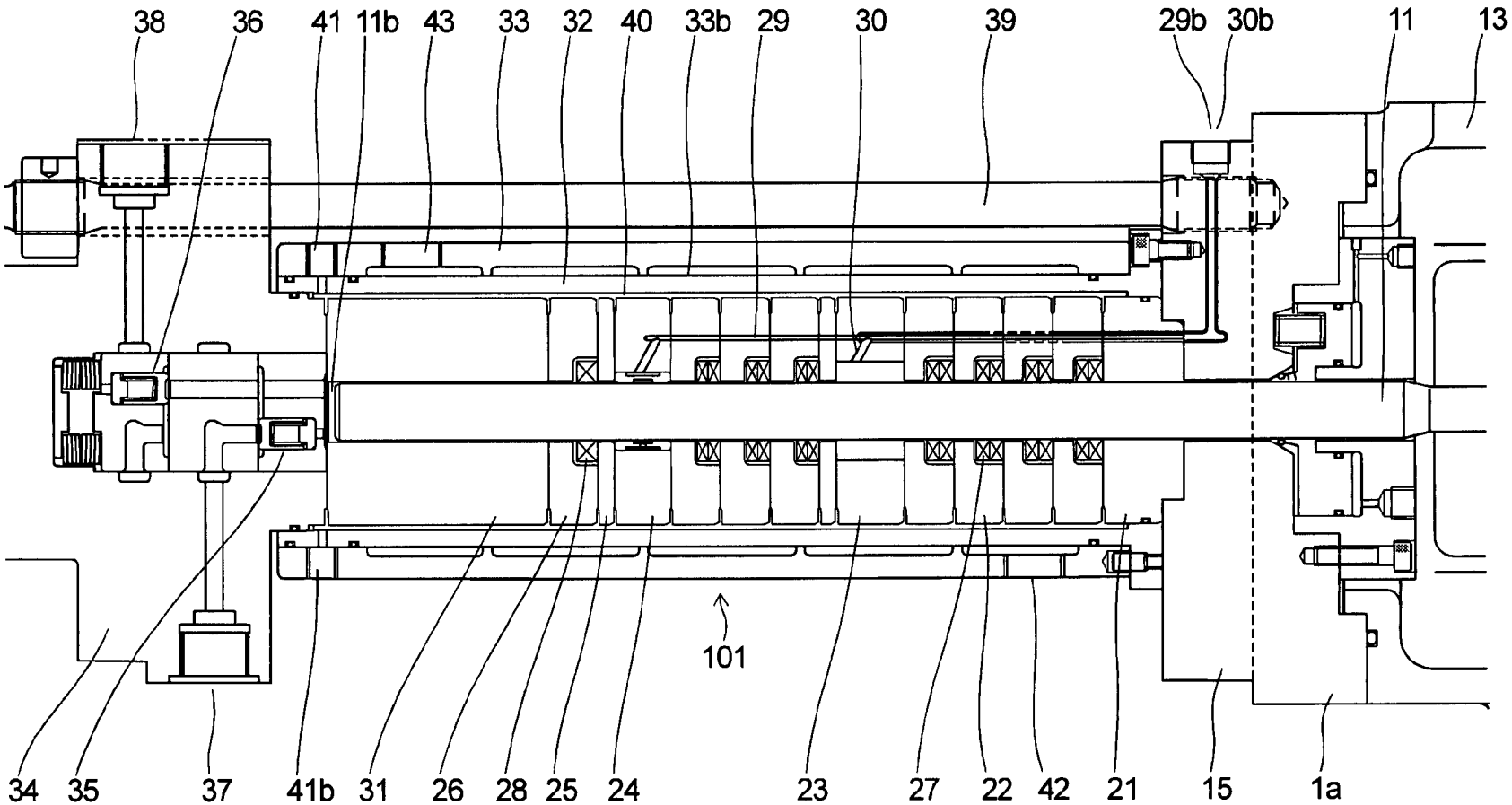
FIG. 5 is a vertical cross-section view, in particular, of a rod packing sealing portion of the plunger compressor shown in FIG. 2.

Details of a portion of the plunger 11 will be shown in FIG. 5. This FIG. 5 is a vertical cross-section view of the plunger 3 and the shaft-sealing portion. The sealing structure shown in this figure is so-called a rod packing seal, in which a large number of chamber rings 22 are laminated in the axial direction thereof, while lying an intermediate ring 23, a guide ring 24, a maintain ring 25 and a chamber ring 26 therein, between a low pressure ring 21 attached onto an interior cover 15 by fitting thereto, which is attached on an end surface of the intermediate shaft 12 in the axial direction thereof, and a cylinder ring 31.

According to the present embodiment, from the side of the low pressure ring 21, there are provided the chamber rings 22 of four(4)-stages, the intermediate ring 23 and the maintain ring 25, the chamber rings 22 of three(3)-stages, the guide ring 24 and the maintain ring 25, and the chamber ring 26 of a single-stage, in that order. Each of those chamber rings 22 holds a rod packing 27 for preventing the actuating gas from leaking out from the outer periphery portion of the plunger 11, on an inner periphery side thereof. Also, the chamber ring 26 locating at the most left-hand side holds a pressure breaker ring 28, on an inner periphery side thereof.

In the case where the actuating gas is a flammable gas, such as, hydrogen gas, for example, it is necessary to protect it from leaking outside, as far as possible. Then, with conducting a first-stage suction line and the intermediate ring, the leakage of the gas compressed in the compression chamber is turned back to a side of the first-stage suction line, thereby forming re-circulation therein. With this conduction, the rod packing of four(4)-stages forms a low-pressure side seal portion, while the rod packing of three (3)-stages a high-pressure side seal portion, respectively. Since the leakage gas from the compressed actuating gas is returned to the first-stage suction side, it is enough to take a measure only for gas leakage of pressure at the first-stage suction, for the purpose of preventing the gas from leaking into an outside of the compressor. Accordingly, it is possible to achieve the minimization of the gas leaking outside the compressor.

Further, copper alloy is used for the high-pressure rod packing, while the material containing a resin, such as, tetrafluoroethylene or PEEK therein, for the low-pressure rod packing. In this case, all of the low-pressure rod packing may be made of resin. The reason of using such the materials lies in that an amount of gas leakage comes up to a problem for the seal of low-pressure side, though also pressure-resistance characteristic is required for the seal at high-pressure side. For this reason, a material is selected to use, which is softer than the seal of high-pressure side. It is obvious that the material of the low-pressure rod packing can be the same as that of the high-pressure rod packing.

An oil supply passage 29 is formed penetrating through each of the rings 21–25, in the axial direction thereof, for the purpose of improving the sealing performances thereof by supplying a very small amount of lubricating oil between the shaft sealing portion and the plunger 11. And, an opening 29*a* is formed in the guide ring 24, which is conducted with the oil supply passage and opened on the inner peripheral surface thereof. However, it may also possible to supply the oil into a stage on the way between those seals of high-pressure side and the low-pressure side. Also, an opening 30 is formed in the intermediate ring 23 disposed in the middle of the shaft sealing portion, which is opened on the inner peripheral surface of this intermediate ring 23 and conducted with an initial-stage suction gas line 37*b* (see FIG. 3). A gas flow passage is formed to conduct with this penetrating opening 30, penetrating through the intermediate ring 23, the chamber ring 22 at low-pressure side and the low-pressure ring 21. The gas flow passage changes the position in the peripheral direction with respect to the oil supply passage 29 for the lubricating oil. Forming a flow passage in the interior cover 15, conducting with the oil supply passage 29 and the gas flow passage, enables the supplies of the lubricating oil and seal gas, from the oil supply opening 29*b* and the gas opening 30*b*, which are provided on the outer periphery side of the interior cover 15. With this, it is possible to take a measure for sealing the high-pressure gas, as well as, to reduce the leakage into an outside down to a very small amount thereof.

On the valve block 34 are formed a suction flow passage for supplying the actuating gas from the suction port 38 into the compression chamber 11*b*, and a discharge flow passage for discharging the operating gas compressed within the compression chamber 11*b* from the discharge port 37. And, on the way of the suction flow passage is provided a suction valve 35, while on the way of the discharge flow passage is provided a discharge valve 36.

The outer diameters of the rings 21–26, which are disposed on an outer periphery of the plunger 11 and the cylinder ring 31 are almost same to each other. And, a cylinder case 32 of thin-thickness, fitting onto those rings 21–26 on the outer periphery thereof, extends from the interior cover 15 up to the valve block 34. An exterior case 33, fitting onto the outer periphery portion of the cylinder case 38, is fixed to the cylinder case 32. Each of those rings 21–26 and 31, which are laminated, is fixed to the intermediate shaft case 1*a*, with using a screw bolt 39 penetrating through the valve block 34, which is fixed to the intermediate shaft case 1*a* at one end thereof, at a plural number of positions in the peripheral direction thereof, on an outer diameter side exceeding the exterior case 33.

On an inner periphery portion of the cylinder case 32, a groove of a fine gap passage 40 is formed along with the axial direction of the plunger 11, and it collects the operation gas leaking out from the laminating surfaces of those rings 21–26 and 31, which are piled up with each other, thereby taking out the leaking gas from a gas bypass opening 41 formed on the exterior case 33 into an outside of the compressor 101. As for this fine gap passage 40, it is also possible to use a knock pin groove for use of positioning each of those rings 21–26 and 31, which are formed in the peripheral direction thereof.

Wide-width grooves 33*b* are formed on the inner peripheral surface of the exterior case 33, at a plural number of positions located in the axial direction thereof, thereby building up a cooling jacket between the cylinder case 38. This cooling jacket removes heat generated due to compression of the operating gas within the compression chamber 11*b*, quickly. A coolant inlet opening 42 for supplying coolant to the cooling jacket is formed on the exterior case 33 near to the interior cover, and a coolant outlet opening 43 for taking out the coolant from the cooling jacket is formed on the exterior case 33 near to the valve block 33. As for the coolant, a lubricating oil or cooling water can be used.

Figure 6:
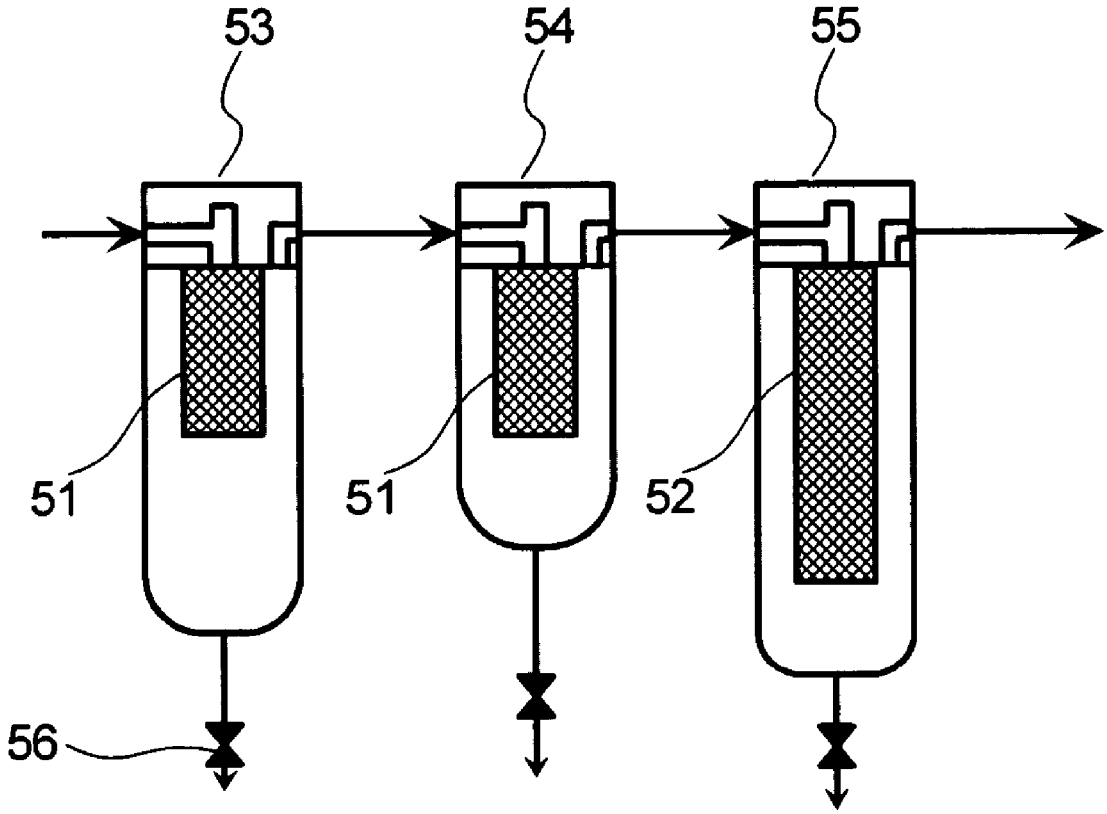
FIG. 6 is a vertical cross-section view of a filter unit, which is applied in the system shown in FIG. 1.

Details of the filter unit 111 will be shows in FIG. 6, which is provided for removing oil components contained within the operating gas after cooling down the operating gas compressed within the second compression stage 103 by means of the cooler 110 provided for cooling thereof. The filter unit 111 filters the lubricating oil on three (3) stages. A primary filter 53 and a secondary filter 54 contain coalescing elements 51 therein, each of which is made from glass micro-fibers bonded through fluorocarbon resin. Also, a third filter 55 contains activated charcoal 52 therein. In a case where the oil components can be removed sufficiently up to the secondary filter 54, it is not always necessary to provide the third filter 55.

The compressed gas coming out from the gas cooler 110 is filtered to be equal or less than 50 ppm in the concentration of oil during when it passes through the element 51 of the primary filter 53. Next, the oil concentration comes down to be equal or less than about 1 ppm, after passing through the element of the secondary filter 54. Further, it comes down to be equal or less than about 5 ppb, after passing through between the activated charcoal of the third filter 54. The oil components filtered out in each of the filters 53–55 are collected through the valve 56. With doing in this manner, the oil components mixing into the operating gas can be reduced down to an amount (for example, equal or less than 1 ppm), which is permissible for the process.

Explanation will be given on the operation of the reciprocating compressor, which is constructed in this manner. When the motor 60 is driven to rotate, the connecting rod 3 engaged with the crankshaft 2 makes rotating movement. Accompanying this, the intermediate shaft 6 and the plunger 11 make the reciprocating movement. Through the reciprocating movement of the plunger 11, the compression chamber changes the volume thereof, thereby compressing the operating gas supplied into the compression chamber 11*b*.

In particular, in the case of compression of hydrogen gas to be used in the fuel-cell car, the hydrogen gas sucked at about 20 MPa in the concentration thereof into the first compression stage 102 is compressed up to about 40 MPa. And then, in the second compression stage 103, the hydrogen gas is compressed up to around 84 MPa in the concentration thereof. In this instance, the rotating speed of the motor is 300 rpm, and the stroke of the plunger 11 is 100 mm. The moving velocity of the plunger 11 is about 1 m/sec or around in an average.

A portion of the gas compressed within the compression chamber 11*b* leaks out from the outer periphery portion of the plunger 11 in the axial direction thereof. For reducing the leakage amount of this, a portion of the sucked gas is supplied into the middle portion of the shaft-searing portion as the seal gas. The pressure of this seal gas is at about 10–20 MPa at the gas opening 30*b*. The gas leaking out from the intermediate ring 23 at the side of the compression chamber 11*b* is turned back to the first-stage suction side, therefore it will never comes out into an outside. The gas leaking out from the laminated surfaces of those rings 22–26 and 31 flows into the radial direction thereof, and enters into the fine gap flow passage 40. And, it is discharged into an outside of the compressor from the gas bypass opening 41, with safety. Further, a very small amount of the gas, leaking into the side of the joint portion 10 in the axial direction, is stopped from leaking into the side of the crank case 1 by means of the seal ring 8, which is provided on the outer periphery portion of the guide piston 7, and it is discharged into the outside of the compressor with safety.

Using the sucked gas of the first compression stage 102 as to be the seal gas enables reduction of the difference in pressure, between the shaft sealing portion and the outside of the compressor; e.g., the atmospheric pressure, down to the pressure of difference between the first compression stage and the atmospheric pressure, irrespective of the discharge pressure of the compressor. With this, in particular, in case of compressing the hydrogen gas for use in the fuel-cell car mentioned above, the pressure difference to be sealed up can be reduced down to a degree, ⅛–½ of the discharge pressure. Also, the lubricating oil, leaking out in the very small amount thereof, which is supplied for use of lubrication of the plunger, is discharged into an outside of the compressor from the fine gap flow passage 40 through the bypass opening 41*b*, together with the seal gas. According to the present embodiment, the leakage of the operating gas is guided into the fine gap flow passage 40, so as to flow into an outside of the compressor, and therefore it is not necessary to build up the cylinder case 32 to be a pressure resistance one, thereby enabling to make the compressor small and compact in the sizes thereof.

According to the present embodiment, since the connecting rod 3 is made up from the two(2)-divided connecting rod members 3*a* and 3*b* and the connecting rod member 3*c* fitting to the cross pin 4, while forming the opening portion on the side surface of the crank case, thereby to receive them therein, the crosshead 5 and the connecting rod 3 can be connected to each other within the frame of the crosshead 5. Namely, by penetrating the crankshaft through into the frame of the crosshead, making the crosshead and the connecting rod to be received within the crankcase, and connecting the crankshaft and the crosshead and the connecting rod, it is possible to make the crankcase small and compact in the sized thereof. Also, it is possible to attach the rods 3 connecting to the plungers 11 on the same axis on both side surfaces of the crosshead 5. Further, since the forces generated in the two (2) compression chambers 11*b* and 11*b* are directed to oppose to each other in the axial direction thereof, by means a portion of the cross pin 4, then it is possible to reduce the forces, which are acting upon the connecting rod members 3*a* and 3*b* and the crankshaft 2 in both directions, as shown in FIG. 2.

Also according to the present embodiment, each ring is finished on the contacting surface in the axial direction thereof, through polishing or lapping, for example, to obtain the metal-contact seal, so that the chamber ring and the cylinder ring used in the shaft sealing portion can hold the gas pressure, and therefore the sealing performance can be improved. Also, since each ring of the shaft-sealing portion is squeezed in the axial direction, by using the cylinder ring screw bold, it is possible to reduce the size of the shaft-sealing portion in the radial direction thereof.

According to the present embodiment, the shaft sealing portion of the compressor is divided into the high-pressure side and the low pressure side on the boundary of the intermediate ring, and the middle portion thereof is conducted with the initial suction line, therefore it is possible to reduce the difference between the atmospheric pressure and the gas seal pressure. With provision of the seal ring provided between the guide piston and the guide cylinder for sealing the very small amount of gas leakage coming out into the crankcase side even if using this seal gas, and with provision of the line for discharging it into the atmosphere from the distant piece, therefore, it is possible to prevent the operating gas or the seal gas from leaking out into the crank chamber. This brings about an effect of completely removing a possibility that the lubricating oil stored in the crankcase is ignited with bearing electrostatic thereon, in particular, when the operating gas is the flammable one, such as, the hydrogen gas, for example.

Further, according to the present embodiment, since the outer periphery of each of those rings, building up the shaft sealing portion, is same to the outer periphery of the cylinder ring each other, so that they can be installed into one (1) piece of cylinder case, and also since the fine gap flow passage is formed to conduct with the inner periphery side of the cylinder case in the axial direction thereof, it is possible to guide the gas leaking out from the contact surface of each ring into an end portion at the side of cylinder or distant piece, and therefore, it is possible to let the operating gas to flow out into an outside of the compressor, with safety, even if it is a flammable one. Also, the cylinder case can be made of a non-pressure resistant part, therefore it is possible to make the shaft-sealing portion small in the sizes thereof.

Furthermore, according to the present embodiment, since the coalescing filter made of glass micro-fibers bonded through fluorocarbon resin is attached onto the discharge line of the compressor, or together with the activated charcoal, it is possible to reduce the oil components mixing into the operating gas down to be equal or lower than a level, which is permissible for the process in the concentration thereof.

In the rod packing seal of the embodiment shown in the above, the cylinder case extends from the interior cover 15 up to valve block 34. And in an inside of this cylinder case 32, the rings 24 to 26 and the cylinder 31 are mounted therein. On an outside of the cylinder case 32 is mounted the exterior case 33. With such the structure, it is possible to collect the gas leaking from the contacting surface of the respective rings 24–26, and 31, by using the grooves formed on the inner periphery of the cylinder case 32 extending in the direction of the axis thereof. The gas collected can be discharged into an outside of the machine with safety through the gas bypass opening 41 formed in the exterior case.

On a while, heat is generated through compression of the actuation gas and sliding of the plunger 11 and the packing. It is also important to radiate the heat with effectiveness. Other embodiment will be explained by referring to FIGS. 7 and 8, in which priority is given to this radiation of heat.

Figure 7:
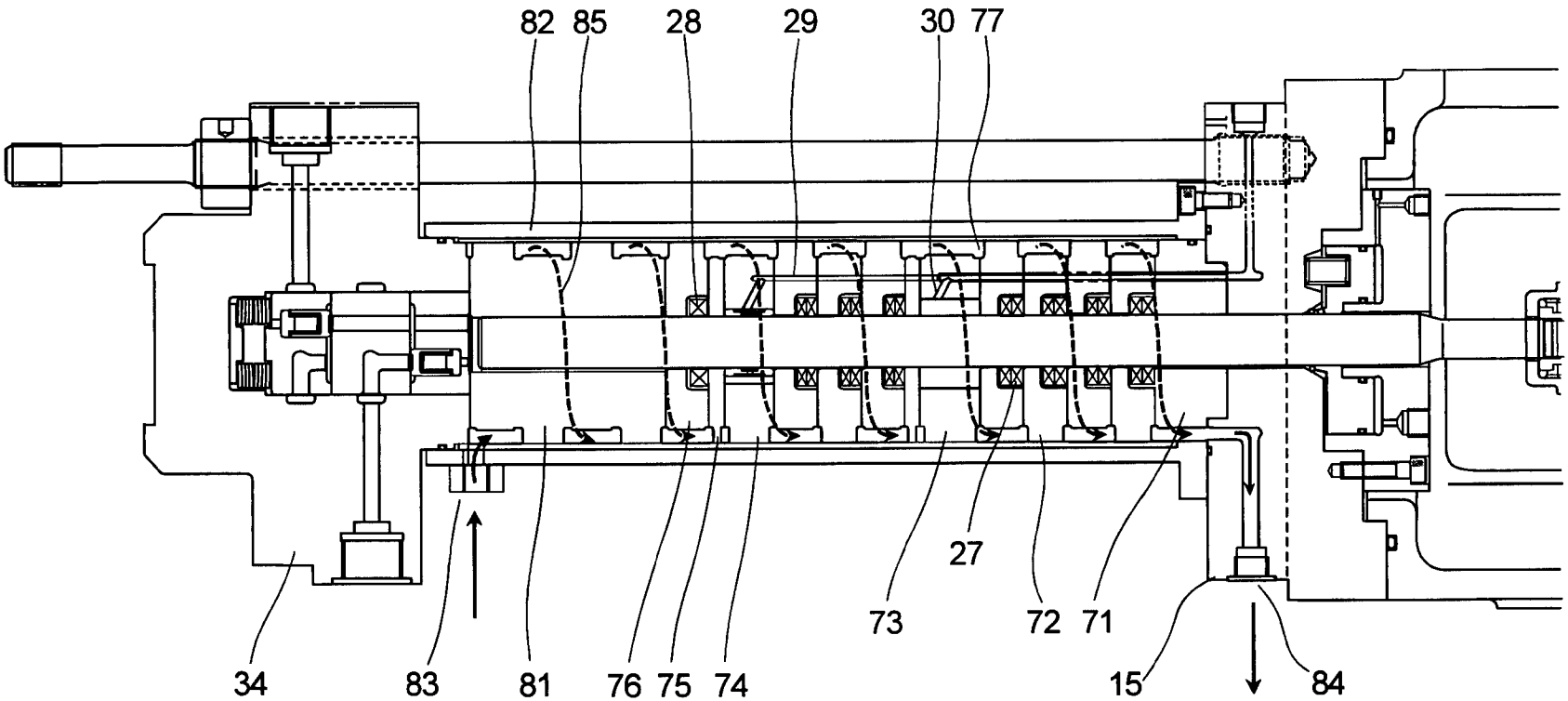
FIG. 7 is a vertical cross-section view, in particular, of a rod packing sealing portion of the plunger compressor of another embodiment of the plunger-type reciprocating compressor according to the present invention.

FIG. 7 shows a partial cross-section view of a compressor according to the present embodiment. On an outer periphery of the plunger 11 are disposed: a low-pressure ring 71, a chamber ring 72, an intermediate ring 73, a guide ring 74, a maintain ring 75, a single-stage chamber ring 76, and a cylinder ring 81. And those rings 71–76 and 81 are attached on an inside of a cylinder case 82 extending from the interior cover 15 up to the valve block 34, respectively. Cut out portion is made on the outer periphery of each of those rings 71–76 and 81, one by one, and also a bypass passage 77 is formed on an outer priority thereof.

On the other hand, between the inner peripheries of the cylinder case 32 and the respective rings 71–76 and 81, passages not shown in the figure are formed, communicating therebetween in the direction of the axis thereof. An opening 83 is formed at an edge of the valve block 34 of the cylinder case 32, so that a cooling liquid flows into the above-mentioned passage from an outside thereof. An opening 84 is also formed in the interior cover 15 communicating with this passage, so that the cooling liquid can flow therein.

Such as, lubricating oil, for example, is used, as the cooling liquid mentioned above. The lubricating oil is supplied from the opening 83, and the lubricating oil cools down the respective outer periphery surface of the rings 71–76 and 81, as shown by broken lines 85 in FIG. 7, directly. After cooling down the outer periphery surfaces of those rings 71–76 and 81, the lubricating oil flows into a side of the interior cover 15, and flows out into an outside of the machine through the opening 84. According to the present embodiment, it is possible to radiate the heat generated through the gas compression and the ring sliding, effectively, thereby contributing to extension of the life-time of the packing, as well as, an improvement of efficiency of the compressor.

However, with the present embodiment, the gas is mixed into the cooling liquid when the actuating gas comes out from the contact seal surfaces of the respective rings 71–76 and 81. Then, the gas is divided from the cooling liquid, according to the method shown in FIG. 8.

Figure 8:
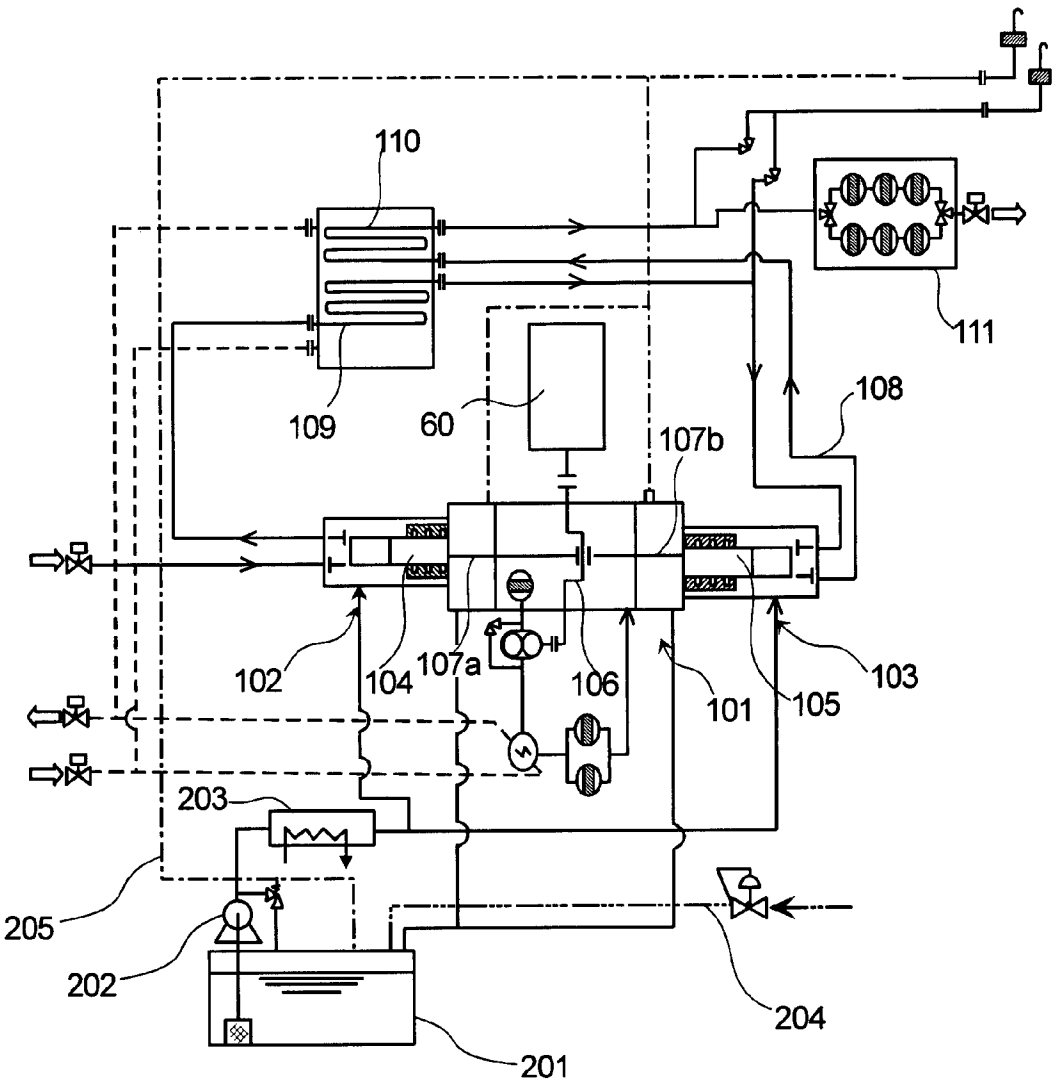
FIG. 8 is a system flow chart in another embodiment of the plunger-type reciprocating compressor, according to the present invention.

FIG. 8 shows a system flow chart when using the compressor according to the present embodiment shown in FIG. 7. The cooling liquid is sucked into from a reservoir tank 201 for cooling liquid, by using a pump 202. The cooling liquid rising up in pressure within the pump 202 is supplied to the respective compressor stages 101 and 102, passing through a cooler 203. The liquid cooling down the respective compressor stages 101 and 102 is turned back to the tank 201. A bent-line 205 is provided on an upper surface of the tank 201, so that the leaking gas can be discharged into an outside of the machine. Further, with provision of a line 204 for purging the tank 201 with an inert gas, such as nitrogen, etc., the safety can be improved much more. According to the present embodiment mentioned above, it is possible to improve the safety of the reciprocating compressor, as well as, to reduce the thermal load thereupon, thereby improving the reliability of the reciprocating compressor.

According to the present invention, with adapting the frame-like crosshead of the one-body structure, the crankshaft can be into the frame of this crosshead, therefore it is possible to provide a small-capacitive and high-pressure hydrogen gas compressor, which is small and compact in the sizes thereof. Also, it can be used to be the hydrogen gas compressor, being superior in the safety and the reliability thereof, in particular, when compressing the hydrogen gas to be used in the fuel-cell car.

What is claimed is:

1. A reciprocating compressor, comprising:

a crankshaft;

a connecting rod, one end thereof being connected to said crankshaft;

a crosshead, being connected with the other end of said connecting rod, as well as, a pair of intermediate shafts, each of which extends in opposing directions to each other;

a pair of plungers, each of which is connected to each of said intermediate shafts; and cylinders, each receiving a tip portion of said plunger therein, wherein said pair of plungers moves reciprocally on almost same axis, and said crosshead is formed in one body;

wherein said crosshead is rectangularly shaped and is of a one-body type, and said connecting rod is of a divided type and receivable within a crankcase.

2. A reciprocating compressor, as described in the claim 1, further comprising a crankcase for receiving said crankshaft, said crosshead and said connecting rod therein, wherein on a side surface of said crankcase is formed an opening portion for installing or taking out said crankshaft.

3. A reciprocating compressor, as described in the claim 1, wherein gas compressed by one of said plungers is guided into a compression space which is defined between the other of said plungers and one of said cylinder.

4. A reciprocating compressor, as described in the claim 1, wherein said connecting rod has a first member and a second member, being linked with said crankshaft, and a third member having an opening for being linked with a cross pin provided at a portion connecting with said crosshead.

5. A reciprocating compressor, as described in the claim 1, wherein each of said pair of shafts has a large diametric guiding portion for guiding said plunger to move reciprocally, and a small diametric portion located within said guide portion on a side of said plunger.

6. A reciprocating compressor, as described in the claim 1, wherein each of said pair of shafts has a guide portion for guiding said plunger to move reciprocally, and a seal ring is attached onto an outer periphery surface of said guide portion.

7. A reciprocating compressor, as described in the claim 1, wherein rod-packing seals, which are laminated in multiple-stages in an axial direction thereof, are provided on an outer periphery side of said each plunger, and said rod packing seals are divided into a high-pressure side seal portion and a low pressure side seal portion by conducting a middle portion of said rod packing seals in an axial direction thereof to a suction flow passage of gas sucked into said compressor.

8. A reciprocating compressor, as described in the claim 7, wherein the rod packing of said low-pressure side seal portion includes a material, being softer than the rod packing of said high-pressure side seal portion.

9. A reciprocating compressor, as described in the claim 7, wherein the rod packing of said low-pressure side seal portion includes a resin material.

10. A reciprocating compressor, as described in the claim 1, wherein the operating gas is high-pressure hydrogen gas, and discharge pressure of said compressor is equal to or larger than 40 MPa.

11. A reciprocating compressor, as described in the claim 10, wherein a filter is provided at a discharge side of said compressor, for removing lubricating oil contained within the operating gas, which are leaks out from said compressor.

12. A reciprocating compressor, as described in the claim 11, wherein the operating gas is high-pressure hydrogen gas, thereby supplying high-pressure hydrogen gas to a hydrogen gas container to be used in a fuel-cell car.

13. A reciprocating, as described in claim 1, further comprising:

rod packing seals disposed on outer periphery portions of a plunger;

cylinder rings disposed on said rod packing seals; and cylinder case for covering the outer periphery portions of said rod packing seal and said cylinder ring, wherein a cooling flow passage is operatively arranged between the cylinder ring and the cylinder case.

14. A reciprocating compressor of two stages, having:

a crankshaft; and a pair of plungers, said plungers being disposed on sides opposing to each other, so as to put the crankshaft therebetween on a same axis thereof, wherein operating gas is compressed by converting rotating movement of said crankshaft into reciprocating movement of said pair of plungers, and further comprising:

rod packing seals, each being formed in multiple-stages in an axial direction thereof and disposed on an outer periphery portions of each of said plungers;

cylinder rings, being disposed on said rod packing seals at a tip side of each of said plungers; and cylinder cases, each being provided for covering an outer periphery portions of said rod packing seal and said cylinder ring, which are made to be almost same in an outer diameter thereof, wherein fine gap passages are formed between said cylinder case and an outer peripheries of said rod packing seals and said cylinder ring, conducting in an axial direction of said plunger, thereby making up a leakage passage of the operating gas with said fine gas passages, each of said fine gas passages comprising a groove for a nock pin for peripheral positioning.

15. A reciprocating compressor, as described in the claim 14, wherein other cylinder case is provided for fitting to said cylinder case on an outer periphery thereof, thereby forming a cooling jacket between said cylinder case and the other cylinder case.

16. A reciprocating compressor, as described in the claim 15, wherein flows either one of cooling water and cooling oil flows through said cooling jacket.

17. A reciprocating compressor, as described in the claim 14, wherein one of said plungers and said crankshaft are connected with each other through a connecting rod, a crosshead and a shaft, while other of said plungers is connected to said crosshead through other shaft.

* * * * *